US008322291B2

(12) United States Patent
Ceballos-Godefroy

(10) Patent No.: US 8,322,291 B2
(45) Date of Patent: Dec. 4, 2012

(54) DISMANTABLE WRITING DESK STORABLE IN A CASE

(76) Inventor: Ricardo Ceballos-Godefroy, Col. del Valle México (MX)

( * ) Notice: Subject to any disclaimer, the term of this patent is extended or adjusted under 35 U.S.C. 154(b) by 163 days.

(21) Appl. No.: 12/525,640

(22) PCT Filed: Jan. 29, 2008

(86) PCT No.: PCT/IB2008/000233

§ 371 (c)(1),
(2), (4) Date: Feb. 16, 2010

(87) PCT Pub. No.: WO2008/093230

PCT Pub. Date: Aug. 7, 2008

(65) Prior Publication Data

US 2010/0139530 A1 Jun. 10, 2010

(30) Foreign Application Priority Data

Feb. 2, 2007 (MX) ..... MX/a/2007/001405

(51) Int. Cl.
*A47B 85/00* (2006.01)

(52) U.S. Cl. ..... 108/38; 190/11

(58) Field of Classification Search ..... 108/50.01, 108/50.02, 33, 34, 35, 38, 41; 312/241; 280/47.19, 280/47.26, 47.34, 47.35; 190/11, 18 R, 900, 190/103

See application file for complete search history.

(56) References Cited

U.S. PATENT DOCUMENTS

| | | | | |
|---|---|---|---|---|
| 893,694 | A * | 7/1908 | Allenson | 108/38 |
| 1,179,017 | A * | 4/1916 | McVicker | 190/11 |
| 2,222,318 | A * | 11/1940 | McLauthlin | 190/11 |
| 2,406,237 | A * | 8/1946 | Milkoff | 108/35 |
| 3,938,772 | A * | 2/1976 | Andrusiak | 248/461 |
| 4,436,353 | A * | 3/1984 | Tucker | 190/11 |
| 5,429,432 | A * | 7/1995 | Johnson | 190/11 |
| 5,437,367 | A * | 8/1995 | Martin | 190/11 |
| 6,082,838 | A | 7/2000 | Bissu-Palombo | |
| 6,543,613 | B2 * | 4/2003 | Belanger | 190/11 |
| 7,543,704 | B2 * | 6/2009 | Miller | 190/11 |
| 7,901,018 | B2 * | 3/2011 | Baughman | 190/11 |
| 2002/0121063 | A1 | 9/2002 | Mathias et al. | |
| 2002/0134697 | A1 * | 9/2002 | Barnett | 190/9 |
| 2004/0173124 | A1 | 9/2004 | Chang | |
| 2009/0032349 | A1 | 2/2009 | Ceballos-Godefroy et al. | |

FOREIGN PATENT DOCUMENTS

| | | | |
|---|---|---|---|
| BE | 904965 | A1 | 10/1986 |
| DE | 3105225 | A1 | 9/1982 |
| EP | 0575275 | A1 | 12/1993 |
| EP | 0720828 | A1 | 7/1996 |

(Continued)

*Primary Examiner* — Jose V Chen

(74) *Attorney, Agent, or Firm* — Browdy and Neimark, PLLC

(57) ABSTRACT

A dismantable writing desk storable in a case is described. The desk comprises a foldable base; a cover in the form of a housing coupled on the base and serving as a case to store the desk; a leg attached to the cover lower part; a left and right walls coupled to the cover and formed by a lower half and an upper half coupled to each other; and, a foldable board mounted to the left and right walls. To store the desk, the foldable board is detached and folded; the walls are detached and their halves are decoupled; the cover is detached from the base and the leg detaches from the cover, storing therein the base, the leg and both walls halves. In an embodiment, the desk is provided with transparent vertical panels mounted on the cover.

20 Claims, 12 Drawing Sheets

FOREIGN PATENT DOCUMENTS

| | | | |
|---|---|---|---|
| FR | 2786080 | A1 | 5/2000 |
| MX | 212227 | A | 12/2002 |
| NL | 1010850 | C2 | 6/2000 |
| WO | 2006136874 | A1 | 12/2006 |

* cited by examiner

DISMANTABLE WRITING DESK STORABLE IN A CASE

FIELD OF THE INVENTION

The present invention relates to the techniques employed in the manufacture and design of furniture, displays and counters used in public locations referred to as "points of sale" where goods and services are offered to the public; more particularly, it relates to a dismantable writing desk storable in a case.

BACKGROUND OF THE INVENTION

In different places where the public converges for the acquisition and promotion of products and services such as exhibitions, conventions, information centers, trade centers, electoral voting modules, and so on, the use of furniture, displays, and in many cases of desks is necessary such that people can contact suppliers and get to know their products and to make purchase orders. In this regard, a great variety of these pieces of furniture is available and built in wood, metal, with shelves and partitions; however, in general terms, they are difficult to handle and their transportation entails hardships as they are heavy and not allowing to place different items. Most of conventional desks are not foldable and therefore their storage and transportation is too complicated.

To address these problems, a known solution in the prior art has been the creation of dismantable and foldable furniture and desks made form wood, formica, and steel. Nevertheless, their heaviness is a drawback, and, furthermore their transportation is hard.

In the early years, the dismantable or foldable desk designs has been focused to satisfy office and school requirements, and most of all are designed to place computers, such that said desks have holes for the entry of computer cables, compartments and sliding platforms for the keyboard and recesses for the monitor.

As said desks are intended to remain in a place for a long time, a tight joining of their parts is desirable, that is, once the desks are assembled, their disassembly is not envisaged.

This kind of desk is disclosed in U.S. Pat. No. 6,082,838, comprised by a main structure having three pieces attached to each other, two are vertically located and acting as desk stands or legs, each of these pieces is fastened to a horizontally located third piece functioning as the desk front, which desk is easy to store and does not require assembling tools; however, it does not meet the points of sales requirements, since it does not have a board to place advertisements and attractive to people.

In U.S. Patent Application No. 2004/0173124 A1, a computer foldable desk is described, comprising various shelves to place different kind of items, however, once the desk is folded, its transportation is cumbersome.

Now then, the activities on a "point of sale" make the furniture to be used only for two or three days, and then to be stored again, even for one day, they have to be assembled in the morning and stored during nighttime, therefore, an easy assembly for this furniture would have be a design target.

Useful furniture for points of sale are known in the prior art, such as display modules stored in a portfolio form, from the same inventor as for the present invention, and disclosed in Mexican Patent Nos. 212,227; 225,710 and in the International Application No. PCT/IB2005/002083. Nevertheless, the need to provide readily assemble desks taking up a small amount of room when stored, has not been met to date.

SUMMARY OF THE INVENTION

To resolve the prior art drawbacks, the present invention addresses to a dismantable writing desk storable in a case comprised by the following members: a foldable base formed by a first wall and a second wall hingedly attached to the first wall; a cover in a housing form is located over said foldable base, also serving as the desk case. When folding the foldable base, this is stored within the cover.

A leg is another member of the invention, detachably mounted to the cover lower part, preferably, diagonally opposite to the wall juncture forming said foldable base; the leg is also stored within the cover; this leg together with the foldable base support mainly the desk.

The writing desk of the present invention also comprises a left wall laterally coupled to said cover and extending upwards and downwards therefrom, this left wall is formed by a lower half and an upper half coupled to each other and stored in the cover, likewise, there is also a right wall laterally coupled to said cover and extending upwards and downwards therefrom, wherein the right wall is formed by a lower half and an upper part coupled to each other and stored in the cover. The left and right walls increase the stability of the desk and further provide an extended surface to place graphic material.

Moreover, there is a foldable board at the writing desk of the present invention, which is mounted over and connecting the left wall and the right wall, and this board when folded may be stored within the foldable base.

To detach and store the desk form the "assembled" position, the foldable board is detached and folded in half; then, the left and right walls are detached, decoupling their halves; the cover is decoupled from the foldable base, and the foldable board is stored within the foldable base to then fold the foldable base in half; moreover, the leg is detached from the cover which houses the folded base, the leg and the halves forming the right and left walls, thereby achieving the "stored" position for the dismantable writing desk.

In a preferred embodiment of the present invention, the writing desk has as optional members a first and a second vertical panel coupled to each other and coupled over the cover, capable to be stored within the foldable base together with the foldable board. These panels are preferably transparent and aid to improve the desk aesthetics by providing a privacy feeling towards the rear part thereof. Due to the panels, increasing or modifying the foldable base structure or size, or of the cover serving as a case to house all the desk members when stored, is not necessary.

Accordingly, an object of the present invention is to provide a dismantable writing desk which parts are designed sized to be stored within the desk cover.

Another object of the present invention is to provide a dismantable writing desk, which when in its "stored" position, takes up a small amount of room and which can be easily transported.

BRIEF DESCRIPTION OF THE DRAWINGS

The novel aspects deemed as unique to the present invention will be specifically set forth in the appended claims. Nevertheless, the invention—both in terms of its structural organization and to the way it is stored—along with other objects and advantages thereof, will be better understood in the following detailed description of a preferred embodiment, when read in conjunction with the accompanying drawings, wherein:

FIG. 4A is an enlarged view around the coupling zone between the foldable board and the desk left wall.

FIG. 7A is an enlarged view of the coupling zone between both vertical panels.

FIG. 7B is an enlarged view of the coupling zone between one desk vertical panel and the cover thereof.

DETAILED DESCRIPTION OF THE INVENTION

Figure 1:
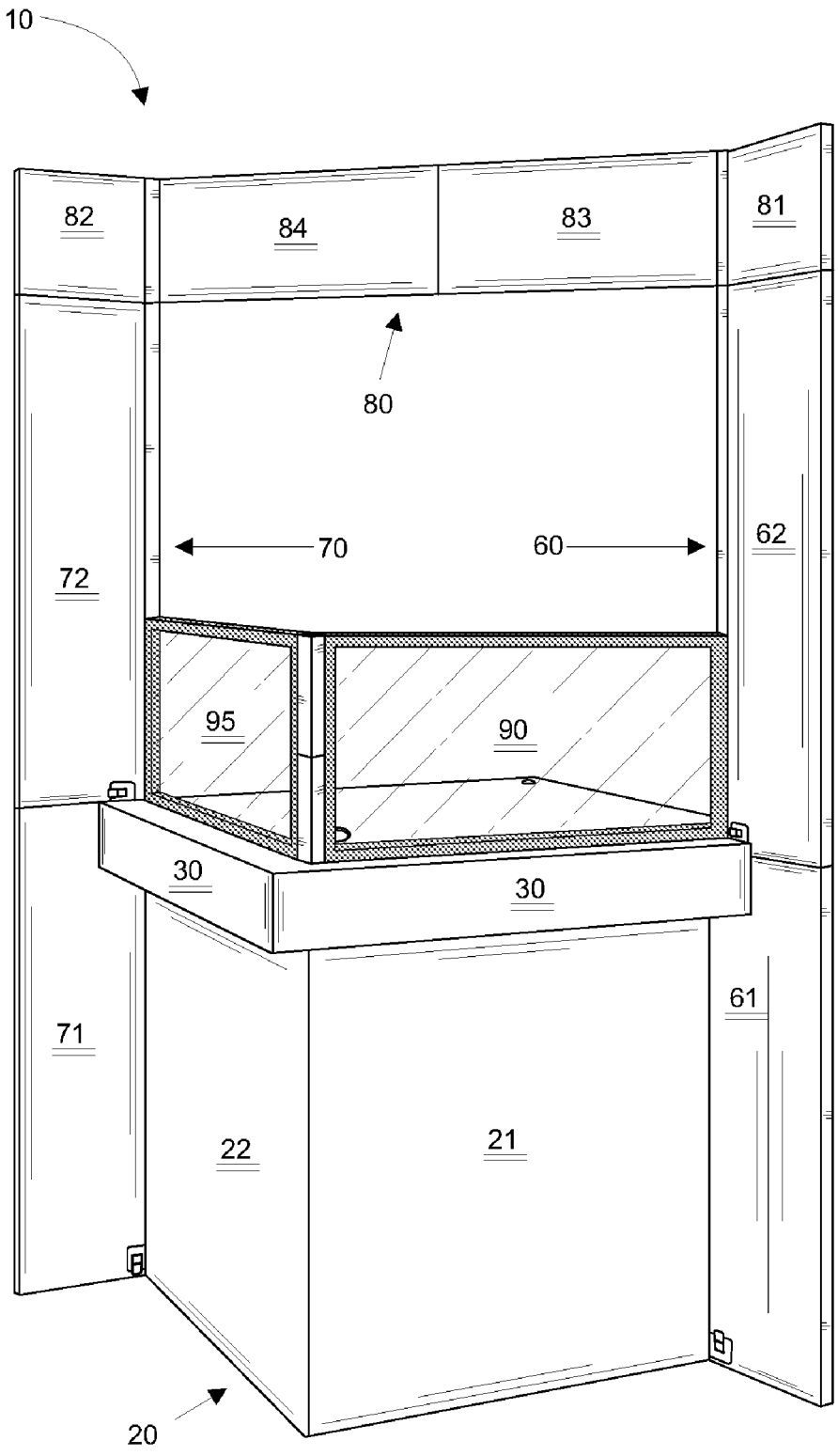
FIG. 1 is a front perspective view of a dismantable writing desk storable in a case, the desk being constructed in accordance with the principles of one preferred embodiment of the present invention.
Figure 2:
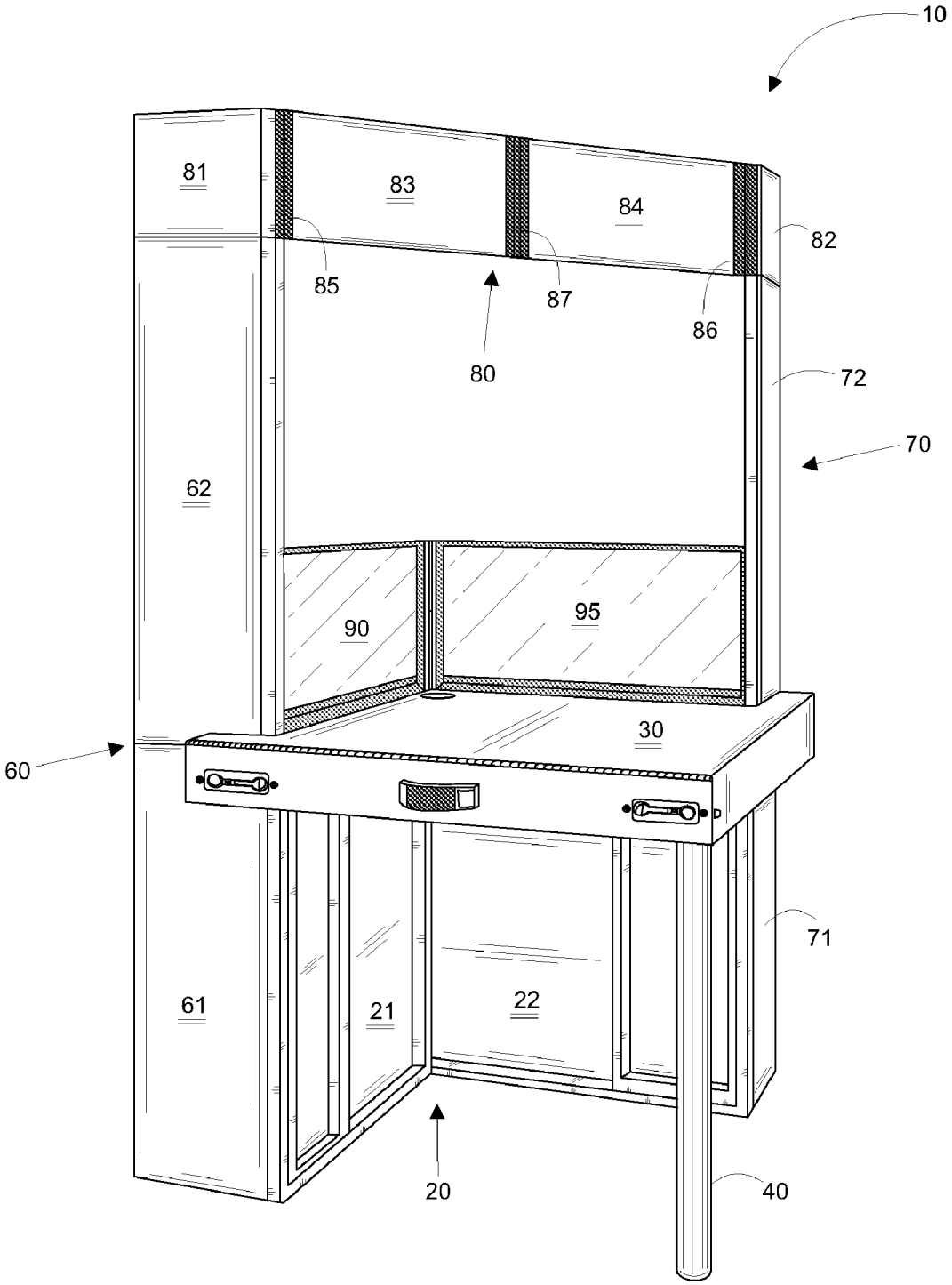
FIG. 2 is a back perspective view of the dismantable writing desk of FIG. 1.
Figure 3:
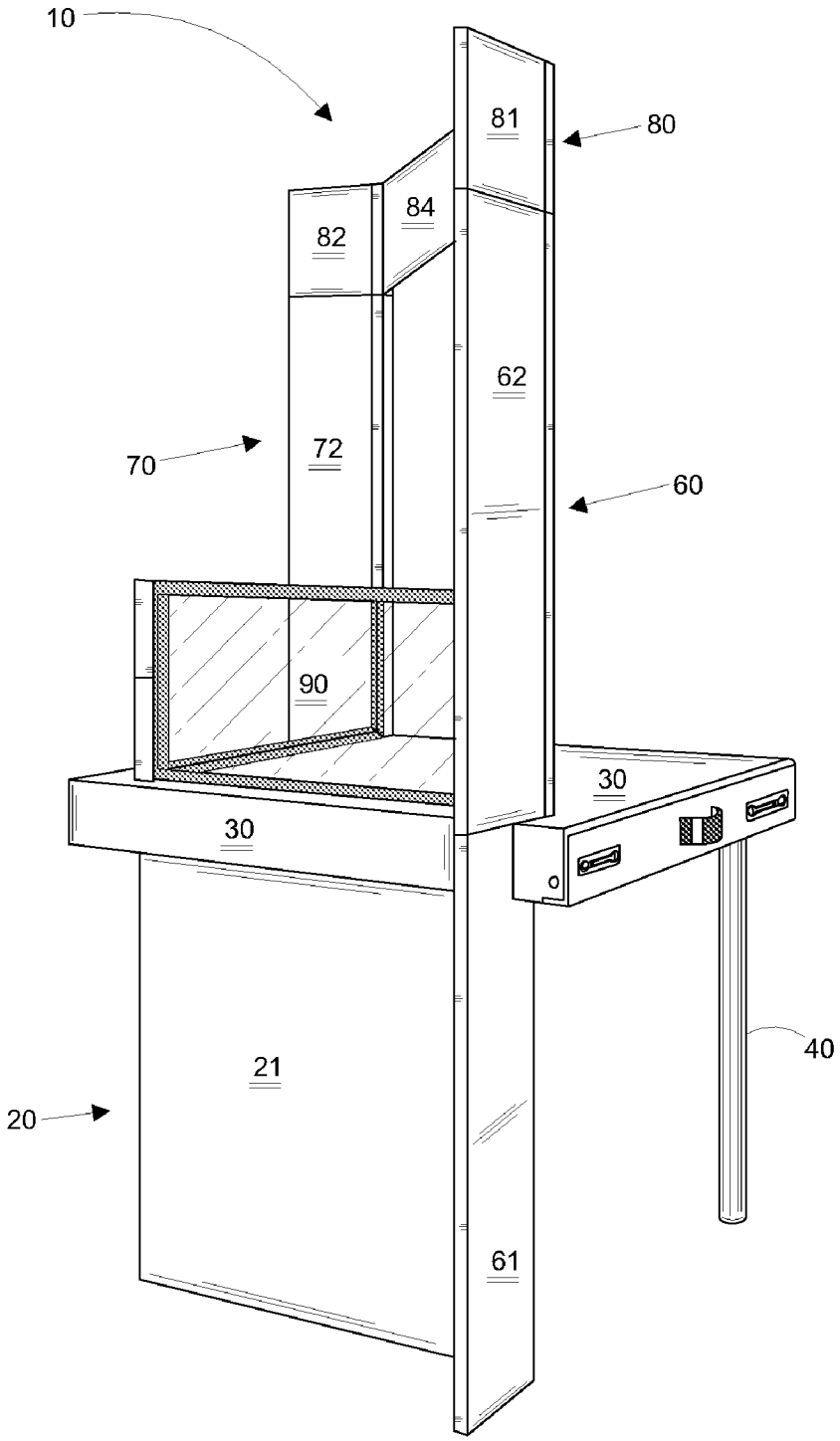
FIG. 3 is a left side perspective view of the dismantable writing desk of FIG. 1.
Figure 11:
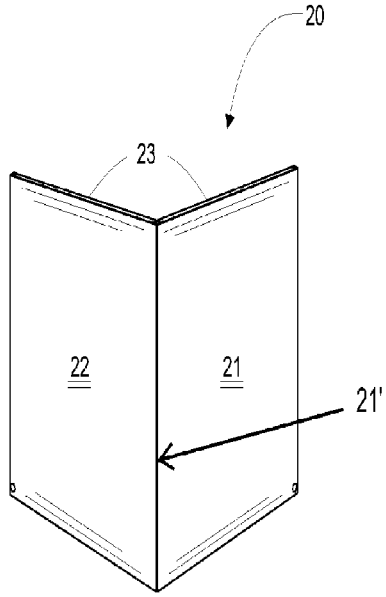
FIG. 11 shows a perspective view of the foldable base.

By particular reference to the accompanying drawings, and more specifically to FIGS. 1 to 3 thereof, a dismantable writing desk 10 storable in a case is shown. The desk is constructed according to one particularly preferred embodiment of the invention, which shall be considered only as illustrative, and not limitative thereof. The dismantable writing desk 10 in this preferred embodiment generally comprises: a foldable base 20 formed by a first wall 21 and a second wall 22 hingedly attached to the first wall 21 by a hinge 21' (FIG. 11). At the desk assembled position, the walls 21 and 22 of the foldable base preferably form an angle of 90°. Further, on the walls 21 and 22 surface, graphic material can be placed.

Over said foldable base 20, a cover 30 is detachably mounted serving as housing, preferably parallelepiped-shaped, and further functioning as the case wherein all the desk 10 parts will be housed. For example, it may be noted that when said base 20 is folded, its size allows the storage thereof within the cover 30.

At the rear part of the desk 10, there is a leg 40 detachably joined to the foldable base lower part 20; the leg 40 is preferably located diagonally opposite to the juncture of the walls 21 and 22 forming said foldable base. The leg is sized to be stored within the cover 30; this leg 40 together with the foldable base 20 support mainly the dismantable writing desk 10.

In FIGS. 1 to 3, the dismantable writing desk 10 is shown, comprising a left wall 60 laterally coupled to said cover 30 and extending upwards and downwards therefrom, said left wall 60 is formed by a lower half 61 and an upper part 62 coupled to each other, and which may be stored within the cover 30.

Likewise, there is also a right wall 70 laterally coupled to said cover 30 and extending upwards and downwards therefrom, said right wall 70 is formed by a lower half 71 and an upper part 72 coupled to each other and stored in the cover 30 as will be explained and illustrated before. The left and right walls 60 and 70 perpendicularly protrude outwards from the desk and are opposite one to the other, preferably being located at opposite corners of the cover 30. Over the left and right wall surfaces 60 and 70, graphic material such as posters, stickers, cardboards, etc., can be placed.

At the desk upper part 10, a foldable board 80 can be seen, mounted over and connecting both the left wall 60 and the right wall 70. This foldable board when folded may be stored within the foldable base 20 which in turn is stored in the cover 30. The foldable board 80 is formed by four sections hingedly attached one next to the other and identified as numeral references 81 to 84, defining a left section 81, a right section 82 and two front sections 83 and 84, left and right respectively. In FIG. 2, the left section 81 is shown hingedly attached to the front section 83 on the same side by the left hinge 85, while the right section 82 is hingedly attached to the right section 84 by the right hinge 86; and the front sections 83 and 84 are hingedly attached to each other by the central hinge 87, allowing to bend and fold the board 80 to a half, while the left 85 and right 86 hinges provide flexibility to the left 81 and right 82 sections of the foldable board 80. It is to be noted that hinges 85, 86 and 87 are preferably plastic hinges and are adhered to the foldable board lower part 80, consequently, they cannot be seen by clients from the desk front part 10. When the foldable board 80 is mounted, this will allow identifying the provider of the goods and services being offered at the dismantable writing desk 10.

In this preferred embodiment of the present invention illustrated in the accompanying drawings, the desk has as optional members a first and a second vertical panel 90 and 95 coupled to each other, preferably forming an angle of 90°, and detachably joined on cover 30. These vertical panels 90 and 95 are sized such that each one individually may be stored within the foldable base 20 together with the foldable board 80. The vertical panels 90 and 95 are preferably transparent and aid to improve the desk 10 aesthetics providing a privacy feeling towards the rear part thereof, where the goods or services provider and his/her client are intended to be seated.

Figure 4:
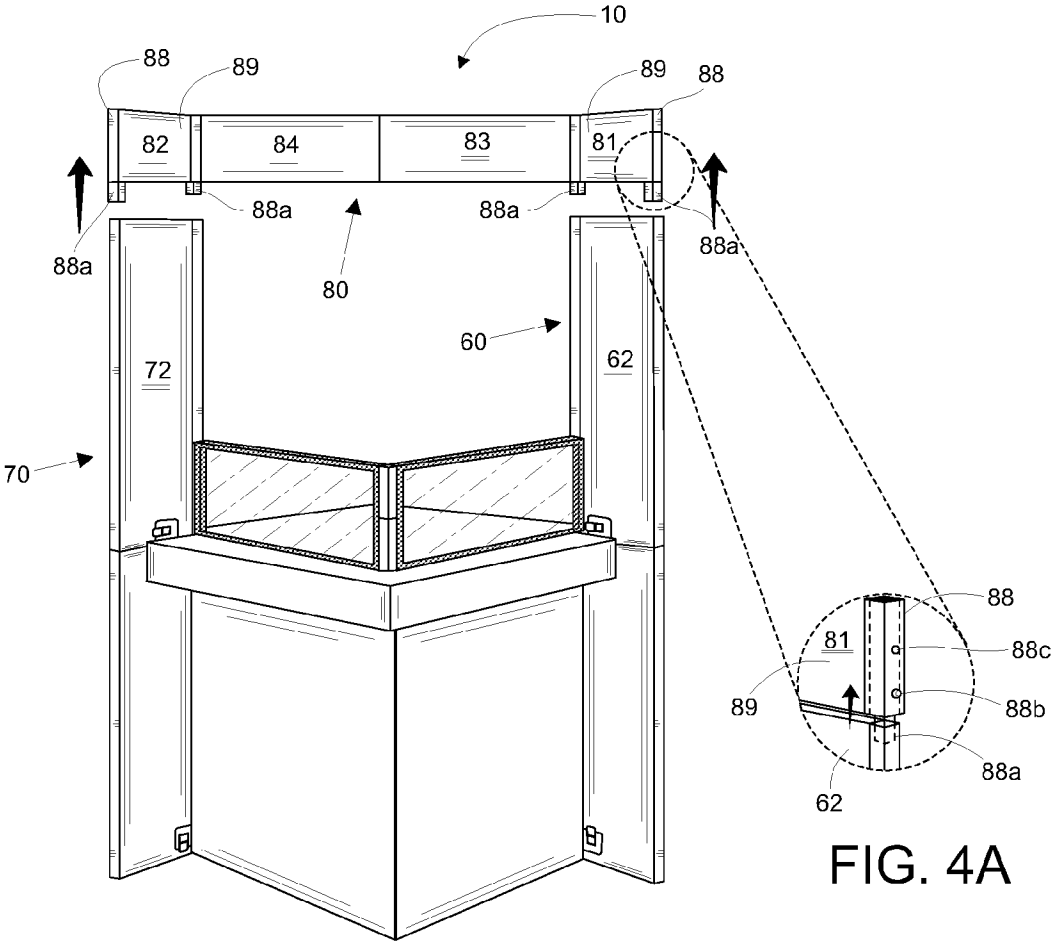
FIG. 4 is a front perspective view showing the foldable board being decoupled from the desk of FIG. 1.

In the subsequent figures the manner how the desk 10 is detached will be shown. Specifically, from FIGS. 4, 4A, is convenient to explain that each foldable board left and right sections 81 and 82 is formed by a frame 88, preferably in a rectangular shape, and having a pair of plates 89 joined to the frame faces 88 in a sandwiched manner. Each left and right sections 81 and 82 includes a pair of coupling sections 88*a* provided at the frame side flanks 88 and protruding downwards from the foldable board 80. One of said coupling sections 88*a*, preferably that located at the free end of the left or right sections 81 or 82, is slidably and runs inside within the frame side flank 88, further including a pin 88*b* trespassing bores 88*c* provided at the frame 88. When the pin 88*b* is pressed, this gets free from one bore 88*c* allowing to move the coupling section 88*a* within the frame so it protrudes to a higher or lower length; the more protruding the coupling section 88*a*, the deeper the coupling section 88*a* could be introduced into the upper half 62 or 72 of the left or right wall 60 or 70, consequently achieving better stability for the foldable board 80 (see FIG. 4A), where this detail at the foldable board left section 81 is shown. In other words, the coupling between the foldable board 80 and the upper halves 62 and 72 of the left and right walls 60 and 70 is achieved because the coupling sections 88*a* are received within the corresponding upper half 62 and 72.

Figure 5:
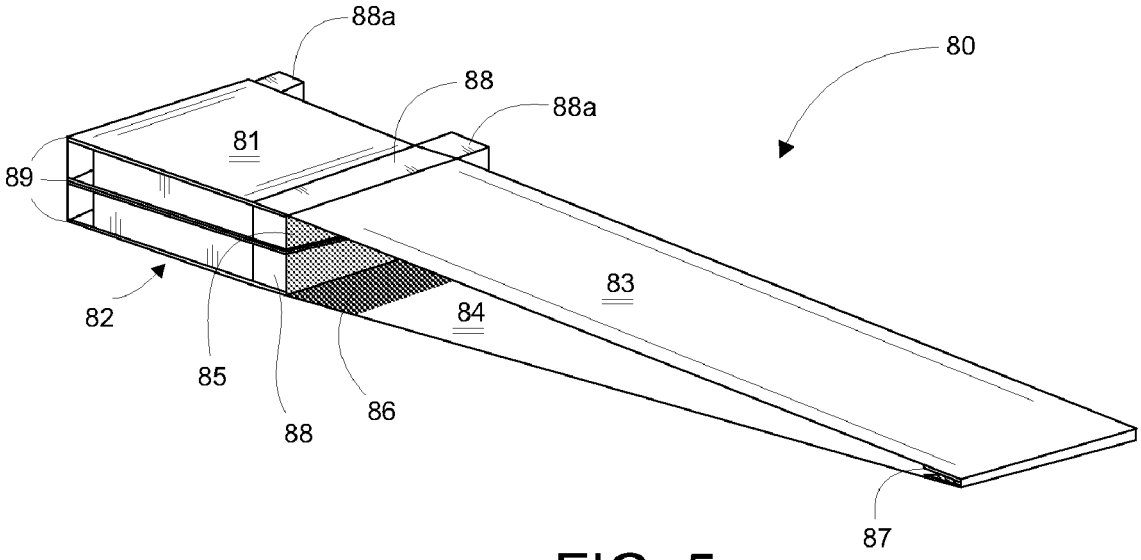
FIG. 5 is a perspective view of the board folded to a half.

The foldable board 80 detaches from the walls 60 and 70 by pulling it upwards, and once the foldable board 80 is detached, it is folded in half to be reduced a half its size ending at the position illustrated in FIG. 5, wherein each section 81 to 84, and hinges 85 to 87 hingedly attaching said sections, the frame 88 of the left section 81 and of the right section 82, the plates 89 covering the corresponding frame faces 88 and coupling sections 88*a*, are identified.

Figures 6, 6A, 6B:
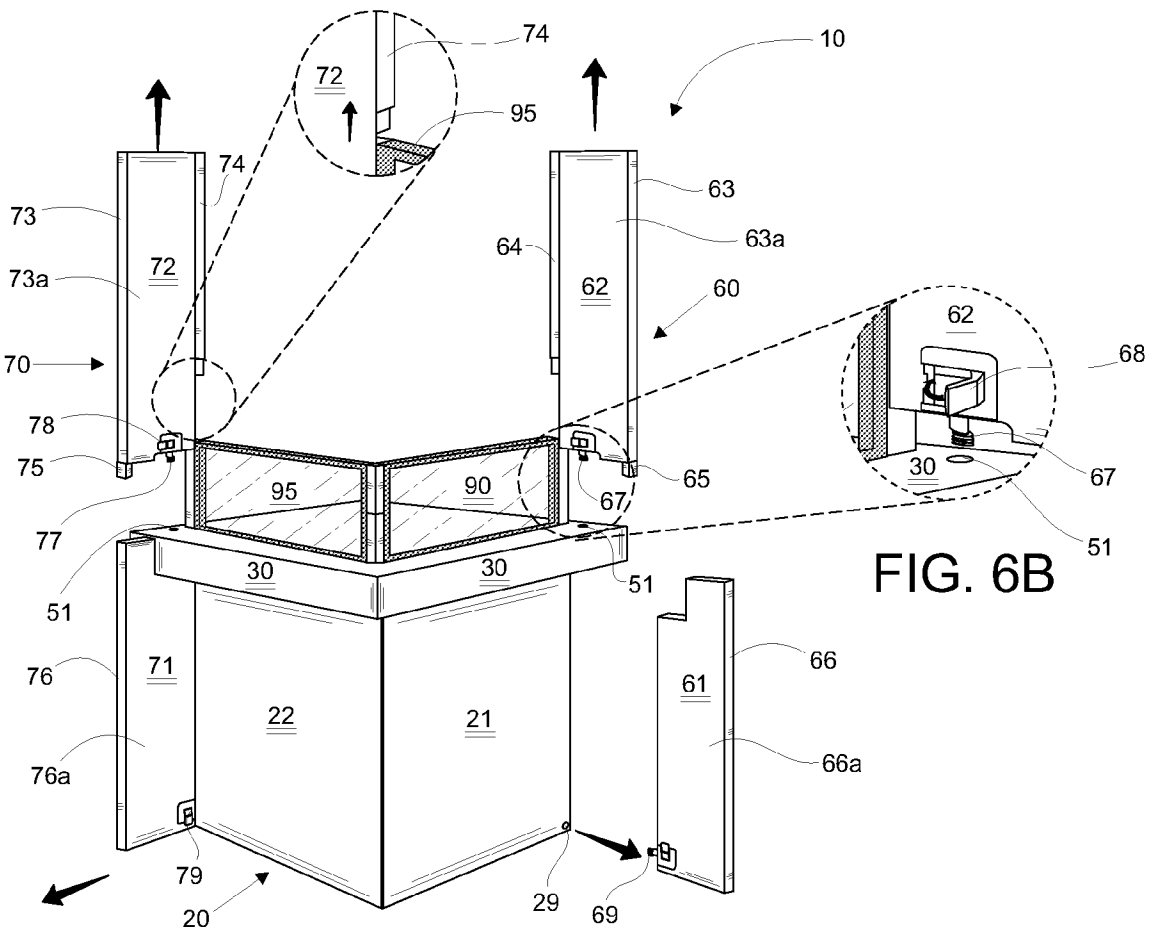
FIG. 6 is a front perspective view of the desk of FIG. 4, illustrating the way to decouple the module left and right walls from the remainder of the desk.
FIG. 6A is an enlarged view of the coupling zone of the right wall upper half with one desk vertical panel.
FIG. 6B is an enlarged view of the coupling zone of the left wall upper half with the cover.

Now reference will be made to FIGS. 6, 6A and 6B, wherein the desk 10 is shown without the foldable board and with the left and right walls 60 and 70 being detached. As mentioned above, the left wall or the right wall 60 and 70 are formed by a lower half 61 or 71 and an upper part 62 or 72 coupled to each other. In the preferred embodiment being described, both upper halves 62 and 72 are formed by an upper frame 63 or 73 with one preferably with a rectangular shape which lower part has such shape to be coupled to the cover 30 upper part contour. Furthermore, the upper halves 62 and 72 include plates or sheets 63*a* and 73*a* coating both upper frame faces 63 and 73.

Now then, the upper halves 62 and 72 include a coupling post 64 and 74 attached to the frame inner flank 63 or 73 and also include a coupling portion 65 and 75 attached to the frame outer flank lower part 63 or 73 and protruding downwards therefrom. The frame 63 and 73 of each upper half and its coupling post 64 and 74 are hollow, such that in the upper end thereof the coupling sections 88*a* of the left or right sections 81 or 82 of the foldable board 80, are received (see FIG. 4). On the other hand, the coupling post lower flank 64 or 74 couples to the first and second vertical panel 90 and 95 as shown in detail in FIG. 6A for the case of the upper half 72 and the second vertical panel 95.

Accordingly, the coupling portion 65 and 75 of the upper halves 62 and 72 is introduced into the lower half 61 and 71 of the left and right walls 60 and 70, respectively. For this end, each of said lower halves 61 and 71 is formed by a lower frame 66 and 76, preferably rectangular and hollow, which upper part is coupled in shape to the cover 30 side and lower contour. In each lower frame 66 and 76 sheets 66*a* and 76*a* are adhered, such that the lower frame 66 or 76 is sandwiched therebetween.

Another important feature in the present invention is related to the fact that the walls 60 and 70 are fixed both to the cover 30 and to the foldable base 20. Particularly, the upper half 62 or 72 of each wall 60 and 70 includes first fastening means, which in the present embodiment are the bolts 67 and 77 being received in cooperative holes 51 provided at the cover upper part 30 (see FIG. 6B). For said upper halves to be fixed to the cover, the bolt 67 or 77 is introduced into the cover 30 and as the lever 68 or 78 is moved, the bolt 67 or 77 will be laterally moved within the cover 30 in respect to the starting position having at its introduction, and therefore it cannot be taken out from the hole 51, making the upper half 62 or 72, according to the case, to be fixed to the cover 30. Other fastening means such as hook and fiber (Velcro®) male-female coupling sections, etc., may be used.

Likewise, each lower half 61 or 71 of each wall 60 or 70 is fixed to the foldable base 20. To this end, the lower halves 61 and 71 include second fastening means being bolts 69 and 79, which features are identical to the bolts 67 and 77 previously described and being introduced in cooperative holes 29 provided at both walls 21 and 22 of the foldable base 20.

Figure 7:
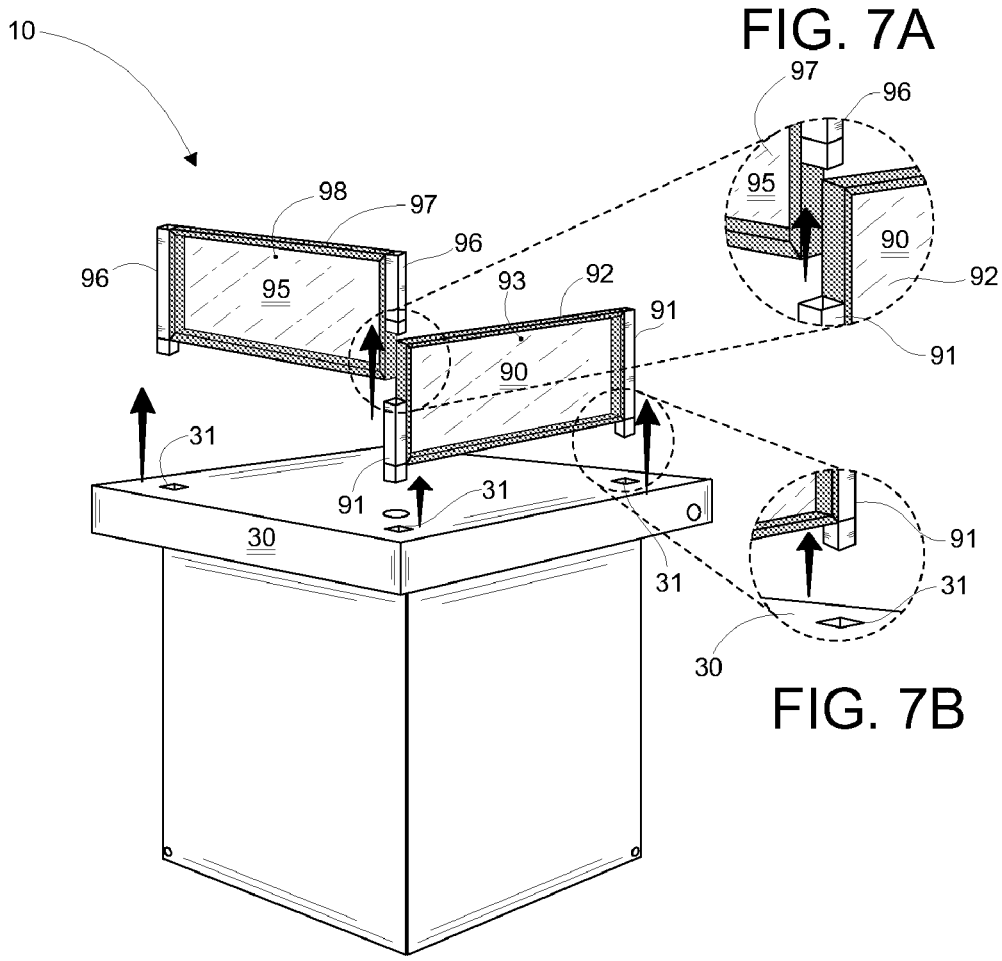
FIG. 7 is a front perspective view of the desk of FIG. 6 wherein the way to decouple the vertical panels from the desk cover is shown.

In FIGS. 7, 7A and 7B the dismantable writing desk is shown, without its left and right walls, and with the vertical panels 90 and 95 being dissembled, in the present embodiment, these vertical panels 90 and 95 are formed by a pair of side coupling posts which at the panel 90 are identified as reference 91 and at the panel 95 as reference 96, a frame 92 or 97 fixed between both side posts and a sheet 93 or 98, supported within the respective frame 92 or 97, the sheet is preferably made of a transparent material as acrylic or polycarbonate, etc. To couple the vertical panels 90 and 95 to the cover 30, this includes three cavities identified as reference 31 formed at its upper face, said cavities 31 receiving the two coupling side posts 91 form the first panel 90 and one coupling side post 96 from the second panel 95, the other coupling side post 96 from the second panel 95 is received within the upper part of one coupling post 91 from the first panel 90, thereby both panels 90 and 95 are coupled to each other at an angle of 90°, this detail may be seen in FIG. 7A. To decouple the vertical panels 90 and 95 from the cover 30, both only have to be moved upwardly (see FIG. 7B) and then decoupling the panels 90 and 95 from each other as shown in FIG. 7A.

Figure 8:
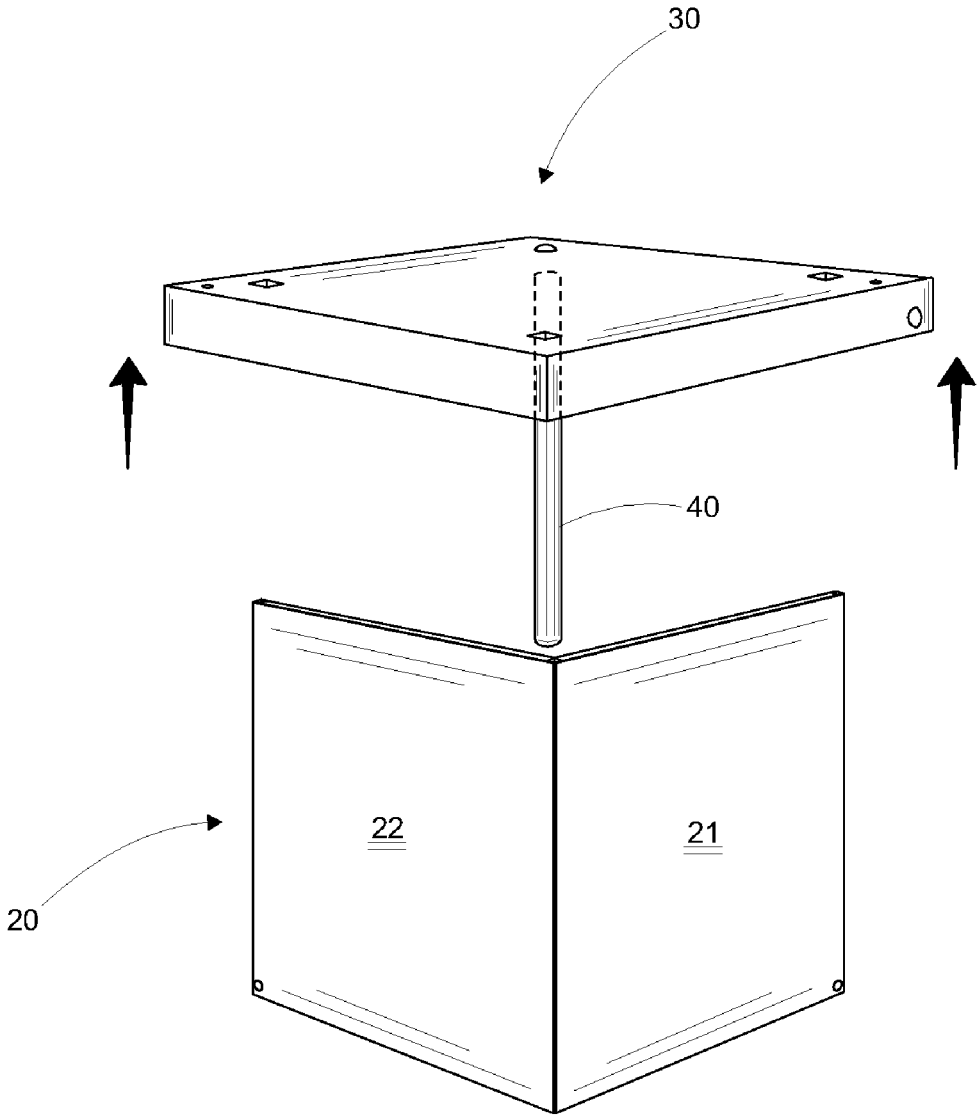
FIG. 8 is a front view of the desk of FIG. 7 showing the decoupling between the cover and the foldable base.

In FIG. 8, the dissembling of the cover 30 from the foldable base 20 is shown, which is achieved by an upwardly movement. In this FIG. 8, the leg 40 may be seen, being mounted to the cover 30 and diagonally opposite to the juncture of the walls 21 and 22 forming the foldable base 20.

Figure 9:
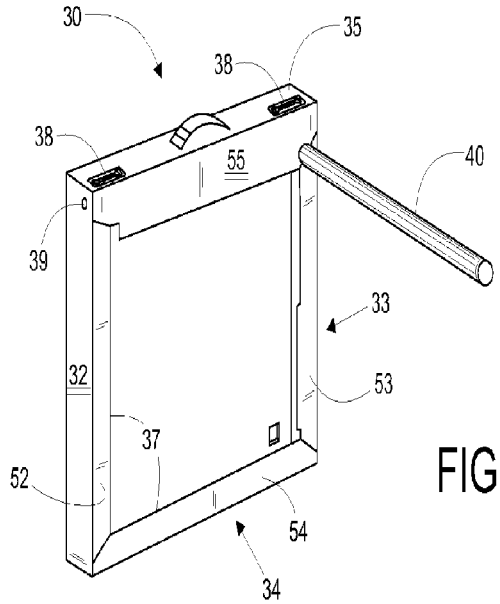
FIG. 9 is a lower perspective view of the cover and desk leg of FIG. 8.
Figure 10:
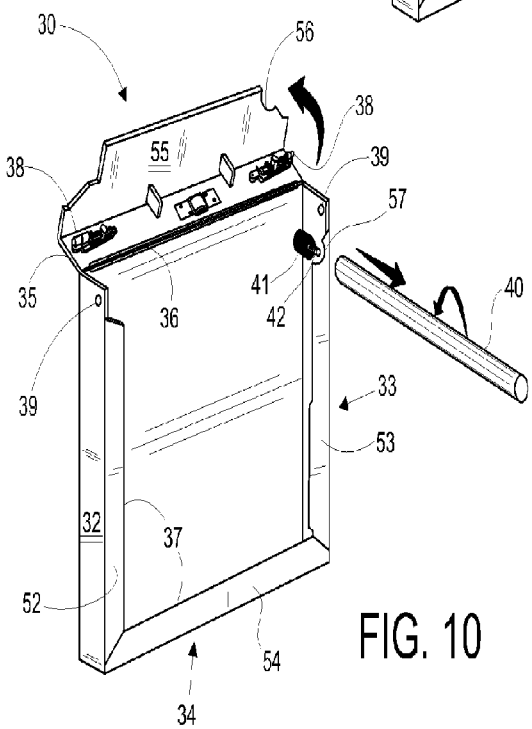
FIG. 10 is a lower perspective view showing the leg being decoupled from the desk cover.

Now, reference is made to FIGS. 9 and 10 to generally describe how the leg 40 is mounted on the cover 30, and how to be detached therefrom. When the desk is assembled, the leg 40 is mounted to a mounting base 41 provided at the inside of the cover 30. The mounting base 41 is preferably a piece of a resilient material such as rubber and includes a central screw 42 protruding from the mounting base 41 and where the leg 40 is screwed or unscrewed. Of course other means and manners of mounting the leg 40 to the cover 30 are possible, e.g., by male-female couplings, or hook and fiber (Velcro®) fastening portions. However, the form disclosed for the preferred embodiment is very practical. The leg 40 can be made of a metal or plastic material and is sized such that when detached, it may be housed within the cover 30, which has its own structure to house the foldable desk members.

The cover 30 has a housing form parallelepiped-shaped having two side faces 32 and 33, and a lower face 34 and a lid 35 hingedly attached to the cover by a longitudinal hinge 36, each side face 32 and 33, the lower face 34 and the lid 35 further include a rib respectively identified as references 52, 53, 54 and 55, protruding inwards the cover 30 and parallel to the surface thereof. The side rib 52 and the rib 54 of the lower face 34 together form an inner rim edge 37 adjusted in size and shape to the upper edge 23 formed by walls 21 and 22 of the foldable base 20 (FIG. 11). The function of the cover 30 being mounted over the base is to avoid lateral movement thereof.

Further, the other side ribs, that is, rib 53 and rib 55 of the lid 35 includes a slit with a half circle shape identified as references 56 and 57; when the lid 35 is closed, said slits 56 and 57 form a hole being trespassed by the leg 40 received and screwed to the mounting base 41. Except for the lid 35, the remainder of the cover 30 is formed in a single piece, preferably a foamed PVC sheet.

On the other hand, the lid 35 is provided with locking means, in the present embodiment being the retractile pins 38, which at their "closed" position, trespass a side hole 39 provided at each side face 32 and 33 of the cover 30. The lid 35 is closed in two instances, the first when the desk is fully assembled to keep the leg 40 fixed and within the gap formed by the slits 56 and 57, and the second when all the desk pieces are stored within cover 30. Other locking means such as latches, clips or padlocks may also be used to fix the lid 35 over the remainder of the cover 30.

Figure 12:
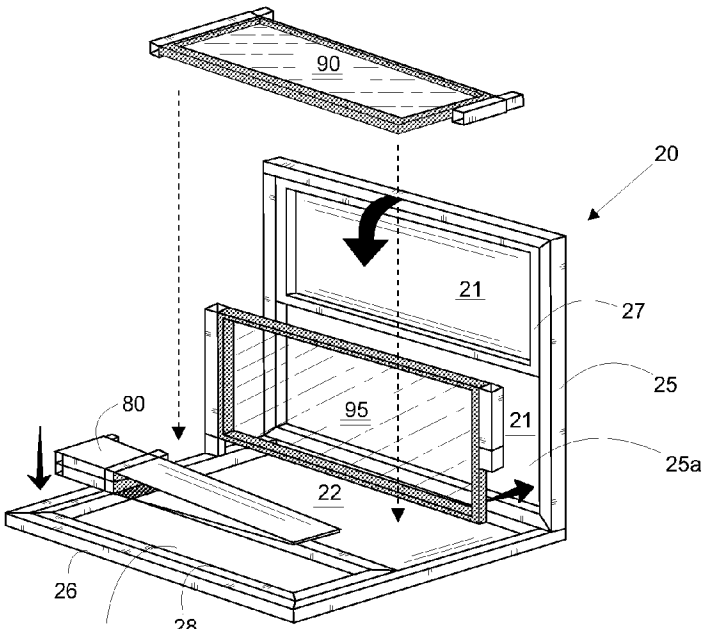
FIG. 12 is a view showing the preferred way to store the panels and board within the foldable base.

Now, reference will be made to FIG. 12 to describe how the foldable board 80 and the vertical panels 90 and 95 are stored within the foldable base 20, which as mentioned above, comprises a first wall 21 and a second wall 22, each wall being formed by a rim frame identified as references 25 and 26, a sheet 25*a* or 26*a* coating them, and an inner frame 27 and 28 functioning to house the foldable board 80 when stored. Furthermore, said inner frames 27 and 28 increase the structural strength of the foldable base 20. Accordingly, panels 90 and 95 are stored one in the first wall 21 and the other in the second wall 22, locating them within the remainder gap of the rim frame 25 or 26 not occupied by the inner frame 27 or 28. Once the panels 90 and 95 and the foldable board 80 are located within their corresponding foldable base 20 gap, the first wall 21 moves over the second wall 22 enclosing the foldable board 80 and both panels 90 and 95.

Figure 13:
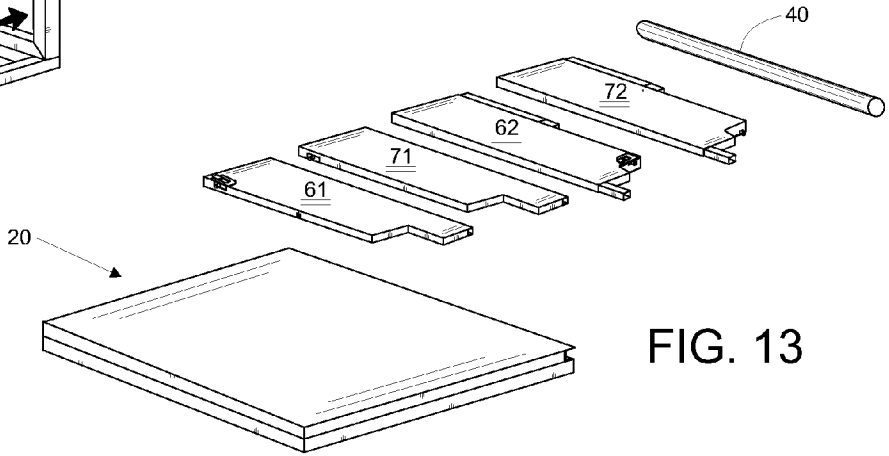
FIG. 13 is a perspective view showing how to accommodate the foldable base, the leg and the left and right wall halves to be stored within the cover.

In FIG. 13, the way to preferably store the lower halves 61 and 71, the upper halves 62 and 72, the foldable base 20 and the leg 40 within the cover is illustrated, as can be seen, the upper and lower halves 61, 71, 62 and 72 are located at a vertical position one next to the other and over the cover 30, there is no an specific order to this end since all these elements perfectly fit within the cover 30.

Figure 14:
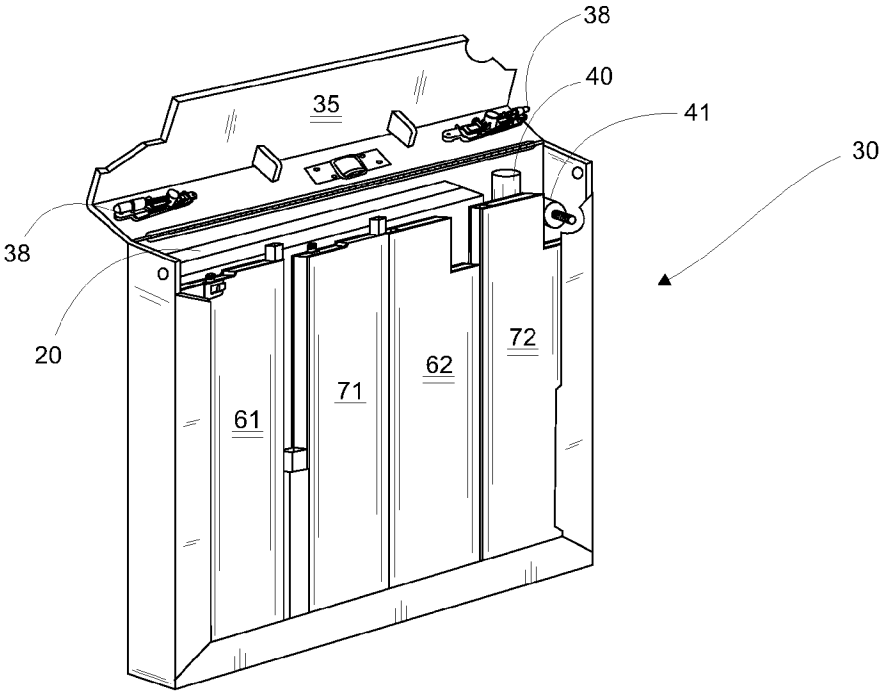
FIG. 14 is a perspective view of the cover with its open lid wherein the foldable base, the leg and left and right wall halves are already stored.

In FIG. 14 the way the lower halves 61 and 71, the upper halves 62 and 72 and the leg 40 are stored within the cover 30 is shown, particularly, all the lower and upper halves are located over the foldable base 20, while the leg 40 is stored between the foldable base 20 and the mounting base 41. In FIG. 14, the lid 35 is open which has to be closed and secured on the remainder of the cover 30 with the retractile pins 38.

Figure 14C:
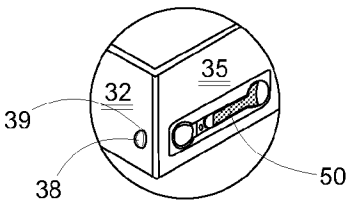
FIGS. 14A to 14C show the operative sequence of the retractile pins serving to close the cover lid.
Figure 14B:
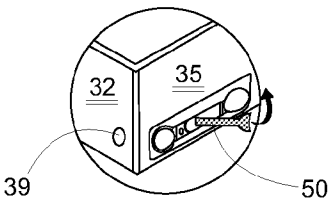
Figure 14A:
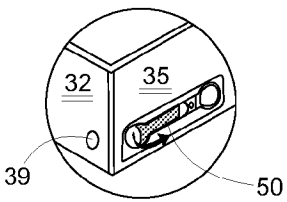
Figure 15:
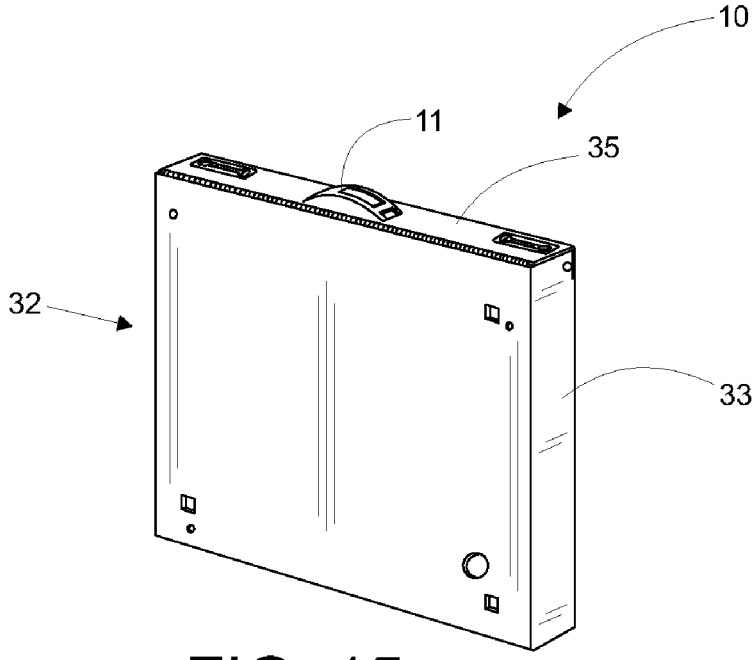
FIG. 15 shows a front perspective view of the dismantable writing desk in its "stored" position with all its parts within the cover.
Figure 16:
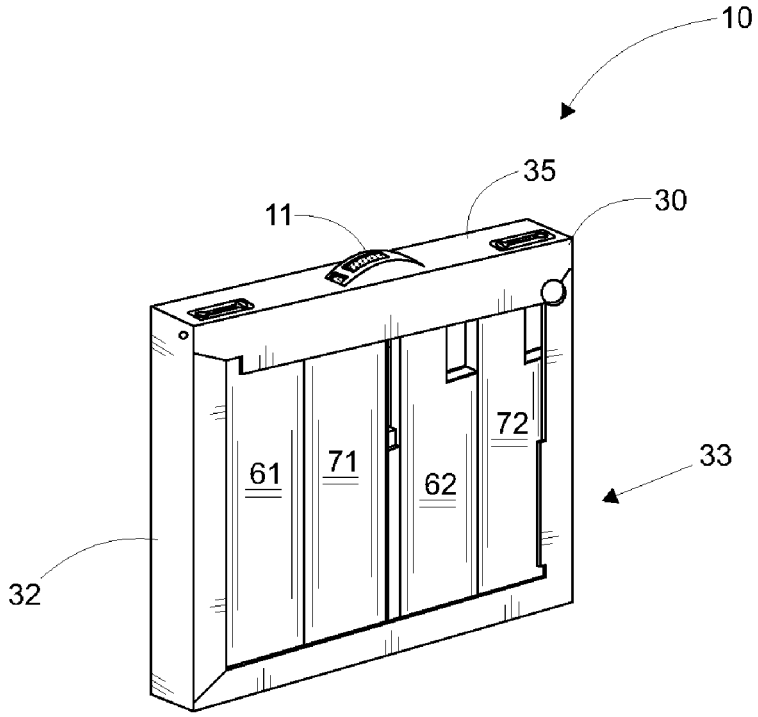
FIG. 16 shows a back perspective view of the dismantable writing desk in its "stored position" according to FIG. 15.

FIGS. 14A and 14C shows the operation sequence of one retractile pin 38 serving to close the lid 35, particularly that actuating on the side face 32 of the cover 30 is shown. The retractile pin 38 is outwardly actuated by a lever 50, which as being moved from one side to another makes the retractile pin to trespass the side hole 39, thereby closing the lid and finally achieving the "stored" position for the desk 10 as shown in FIGS. 15 and 16.

In the present invention, means to grasp the cover are provided, which in the present embodiment is the handle 11 attached on the cover, particularly, the handle 11 is attached centrally to the lid 35; the handle 11 may be hand grasped to move the whole desk 10 already stored. Another means to grasp the cover is a strip which ends are attached to both side faces 32 and 33 of the cover 30. As seen, the desk 10 in its "stored" position shown in FIGS. 15 and 16 has a compact structure, thereby taking up small room, and in the rear part of the desk 10, only the desk walls lower and upper parts 61, 62, 71 and 72 may be noted.

The desk of the present invention has suitable dimensions to be used in "point of sale" sites, e.g. and without intending to be limitative, it has a typical height of about 1.70 m to 2.00 m; the cover is separated away from the floor at a height of 0.80 m to 1.00 m; the cover meters on each side about 80 cm to 1 m, thereby obtaining a wide working surface; and the left and right walls extend outwards the desk in about 20 to 30 cm. These are preferred dimensions, since the most important for the invention is the peculiar coupling way between its parts, and that when dissembled, the desk pieces may be housed within the cover. Regarding its weight, it does not represent an inconvenience, since all the desk parts, such as the frames and plates, are preferably made from polymeric materials such as PVC.

As been observed, the structural relationship among the foldable desk members allow for them to be stored in a very compact manner, such that it may be used in an infinity of applications, being the main use at a "point of sale" site.

Although one preferred embodiment of the present invention has been described and exemplified, it should be stressed that numerous modifications thereto cane be made, such as to the type of hinges employed, the mounting form for the leg, and the dimensions of the desk members. Therefore, the present invention shall not be deemed as limited except for the teachings of the prior art and by the scope of the appended claims.

The invention claimed is:

1. A dismantable writing desk storable in a case, comprising in an assemble position:

a) a foldable base formed by a first wall and a second wall hingedly attached to the first wall by a hinge;

b) a cover coupled over the foldable base, c) a leg located at the rear part of the desk, diagonally opposite to the juncture of the first and second walls, which is detachably mounted to the lower part of the cover;

d) a left wall coupled to the cover and foldable base, which extends upwards and downwards from the cover, and perpendicularly protrude outwards the desk;

e) a right wall coupled to the cover and foldable base, which extends upwards and downwards from the cover, and perpendicularly protrude outwards the desk;

f) a foldable board located at the upper part of the desk, which is mounted over and connecting both the left wall and the right wall;

wherein said foldable base together with the leg, mainly support the dismantable writing desk.

2. A dismantable writing desk storable in a case according to claim 1, further comprising a first and a second vertical panels which are detachably joined on the cover, wherein said first and second vertical panels are coupled to each other forming an angle of 90°.

3. A dismantable writing desk storable in a case according to claim 1, wherein each one of the first and second walls of the foldable base are formed by:

a rim frame;

a sheet covering said rim frame; and, an inner frame inside the rim frame which it has the function to house the foldable board when this is stored.

4. A dismantable writing desk storable in a case according to claim 1, wherein the cover includes a mounting base provided at its inside to mount the leg.

5. A dismantable writing desk storable in a case according to claim 4, wherein the mounting base is a piece of resilient material including a central screw protruding from the mounting base and wherein the leg is screwed or unscrewed.

6. A dismantable writing desk storable in a case according to claim 1, wherein the cover is parallelepiped-shaped having two side faces, one lower face and a lid hingedly attached to the cover by a longitudinal hinge; wherein each of the two side faces, the lower face and the lid further include a rib protruding inwards the cover and perpendicular to the surface thereof.

7. A dismantable writing desk storable in a case according to claim 6, wherein the rib of one of the two side faces and the rib of the lower face together form an inner rim edge that adjusts in size and shape to the upper edge formed by the first and second walls of the foldable base, such that when the cover is mounted over the base lateral travellings thereof are avoided.

8. A dismantable writing desk storable in a case according to claim 7, wherein the rib of the other side face of the two side faces and the rib of the lid include a half-circle slit, such that when the lid is closed the slits form a hole being trespassed by the leg which is received and screwed to the mounting base of the cover.

9. A dismantable writing desk storable in a case according to claim 6, wherein the lid is provided with locking means.

10. A dismantable writing desk storable in a case according to claim 9, wherein the locking means are retractile pins, such that when said locking means are closed they trespass a side hole provided at the side faces of the cover.

11. A dismantable writing desk storable in a case according to claim 1, wherein the left and right walls are coupled to the cover and to the foldable base, and each of said left and right walls is formed by a lower half and an upper half coupled to each other.

12. A dismantable writing desk storable in a case according to claim 11, wherein each of the upper halves of the left and right walls is formed by a rectangular-shape upper frame, which lower part is shaped so that is coupled to the upper contour of the cover; and said upper halves additionally include plates or sheets coating both faces of said upper frame.

13. A dismantable writing desk storable in a case according to claim 11, wherein each of the upper halves of the left and right walls includes first fastening means to be fixed to the cover.

14. A dismantable writing desk storable in a case according to claim 13, wherein said first fastening means are bolts received in cooperative holes provided at the upper part of the cover.

15. A dismantable writing desk storable in a case according to claim 11, wherein each of the lower halves of the left and right walls includes second fastening means to be fixed to the foldable base.

16. A dismantable writing desk storable in a case according to claim 15, wherein said second fastening means are bolts received in cooperative holes provided at the first and second walls of the foldable base.

17. A dismantable writing desk storable in a case according to claim 1, wherein the foldable board is formed by four sections hingedly attached one next to the other and defining a left section, a right section, a left front section and a right front section; wherein the left section is hingedly attached to the left front section by a hinge, the right section is hingedly attached to the right front section by a hinge and the front sections, left and right, are hingedly attached to each other by a central hinge, thus allowing to bend and fold said board to a half.

18. A dismantable writing desk storable in a case according to claim 17, wherein each of the sections, left and right, are formed by a rectangular-shaped frame and having a pair of plates joined to the frame faces; additionally, said left and right sections include a pair of coupling sections provided at the frame side and protruding downwards form the foldable board.

19. A dismantable writing desk storable in a case according to claim 18, wherein the coupling section that is located at the free end of the left or right sections is slidably and runs inside within the frame side and includes a pin attached thereto and trespassing bores provided in the frame.

20. A dismantable writing desk storable in a case, wherein to store the desk as claimed in claim 1, the foldable board is detached from the left and right wall and folded to a half; the left and right walls are detached from the cover and the foldable base and their halves decoupled; the cover decouples from the foldable base and the foldable board is housed in the cover; then the foldable base is folded to a half and stored inside the cover; the leg detaches from the cover and together with the halves of both right and left walls, are housed in the cover, thereby achieving the stored position for the dismantable desk.

* * * * *